United States Patent [19]

Irwin

[11] 3,950,934

[45] Apr. 20, 1976

[54] PLUMBERS SNAKE

[75] Inventor: Lawrence F. Irwin, Calabasas Park, Calif.

[73] Assignee: Augerscope, Inc., San Fernando, Calif.

[22] Filed: Mar. 13, 1975

[21] Appl. No.: 557,930

[52] U.S. Cl. ..... 57/149; 57/162; 15/104.3 SN

[51] Int. Cl.[2] ..... D07B 1/16

[58] Field of Search ..... 57/144, 145, 146, 147, 57/148, 149, 152, 153, 156, 160, 161, 162, 164; 15/164.3 SN

[56] References Cited

UNITED STATES PATENTS

| | | | |
|---|---|---|---|
| 236,031 | 12/1880 | Hookham | 57/149 |
| 2,244,735 | 6/1941 | Silverman | 15/104.3 SN |
| 3,133,584 | 5/1964 | Lang | 57/149 X |
| 3,457,580 | 7/1969 | Meyers | 57/145 X |

FOREIGN PATENTS OR APPLICATIONS

| | | | |
|---|---|---|---|
| 1,092,576 | 11/1967 | United Kingdom | 15/104.3 SN |

*Primary Examiner*—Donald E. Watkins

[57] ABSTRACT

An improved plumbers snake and the method of making same of unique construction having a metal core concentrically disposed within a coiled spring wire member and an intermediate resilient body in gripping engagement with the metal core. The intermediate body includes a helically-shaped protrusion extending along its length, the turns of which are interposed between and operably engage the coils of the spring wire member so as to yieldably resist axial bending of the snake and optimize rigidity and flexibility.

8 Claims, 4 Drawing Figures

PLUMBERS SNAKE

BACKGROUND OF THE INVENTION

1. Field of the Invention

The present invention relates generally to elongated coiled springs for use as plumbers snakes and more particularly to a plumbers snake of novel construction which uniquely optimizes rigidity and flexibility, and to the method of making such a snake.

2. Discussion of the Prior Art

A common type of plumbers snake comprises an elongated coil spring formed of hard drawn wire. The spring is wound tightly generally in a left hand direction so that the coils are in close proximity and resist unwinding when the snake is rotated in a right hand direction within a waste pipe or the like to clear obstructions therein. Under certain operating conditions, these types of springs prove to be too flexible and therefore certain manufacturers provide a metal core to stiffen and strengthen the snake. This latter type of snake has the disadvantage, however, that it has a tendency to assume a permanent set when it is left coiled for any length of time. Further, snakes of this construction are difficult to use in many applications such as around 90° elbows and traps since they lack the required degree of flexibility. Additionally, such snakes tend to kink during operation rendering them unfit for use with the conventional tools employed.

In an attempt to optimize rigidity and flexibility, certain prior art plumbers snakes were provided with a composite core of plastic and metal materials. One of the most successful of these types of devices is described in U.S. Pat. No. 3,149,480 issued to Hunt. This latter device embodies a core of twisted wire strands held centered with respect to an outer coiled spring member by means of an intermediate body formed of a resilient plastic or rubber material. In practice, these devices have proven clearly superior to the prior art all-steel snakes, but still lack the optimum combination of rigidity and flexibility in that for certain applications, greater rigidity is needed. If additional steel wire is added to the core to increase rigidity, however, the desired flexibility is lost.

As will become clear from the discussion which follows, the device of the present invention provides optimum rigidity without sacrificing flexibility. This is accomplished by a unique construction in which right or left hand wound spaced apart spring steel coils formed of oil tempered wire are separated by compressible coils formed of a low density yieldable plastic or rubber material. The compressible coils which separate the steel coils are integral with a generally cylindrically shaped intermediate body formed of yieldable material axially disposed within the interior of the steel coils and surrounding a coaxially aligned metal core constructed of strands of wire. With this novel construction, when the coil spring or snake is bent or flexed, the compressible coils act as a support to the steel coils thereby providing greater rigidity. Because the compressible coils are formed of a resilient, yieldable material, however, the snake remains flexible along its length so that it will easily traverse 90° turns, traps and the like.

In addition to the optimized rigidity and flexibility of the snake of the present invention, it is less expensive to manufacture since less steel is used in coiling. Also, an an added by-product of the unique construction, the yieldable material disposed between the steel coils protects the steel coils against corrosion and wear thereby substantially increasing the useful life of the device.

SUMMARY

The object of the invention is to provide a plumbers snake, or coil spring, of unique construction which embodies a metal core concentrically disposed within a coiled spring wire member and an intermediate resilient body adapted to securely grip the metal core. The intermediate body comprises a spiral shaped protrusion along its length, the turns of which are interposed between and operably engage the coils of the spring wire member so as to yieldably resist axial bending of the snake.

Another object of the invention is to provide a plumbers snake of the above mentioned character which exhibits superior strength and rigidity characteristics, but yet is flexible enough to traverse traps and sharp bends encountered in pipes and plumbing fixtures being cleaned.

A further object of the invention is to provide a plumbers snake as described in the preceding paragraphs in which the coils of the intermediate body closely engage the coils of the spring wire so as to protect it from wear and corrosion.

Another object is to provide a snake which is easy to use, will not take a permanent set when coiled and will not kink during normal use.

Still another object is to provide a snake which embodies a minimum amount of metal and is, therefore, economical to manufacture but nevertheless is strong, durable and reliable in use.

A further object is to provide a unique method of making a snake of the character described in the preceding paragraphs in which the intermediate body of resilient plastic or rubbery material is formed around a metal core, a spring wire is then tightly coiled around the intermediate body and finally, the assemblage is controllably heated to cause the material of the intermediate body to be extruded between the turns of the coiled spring wire.

DESCRIPTION OF ONE EMBODIMENT OF THE INVENTION

Figure 1:
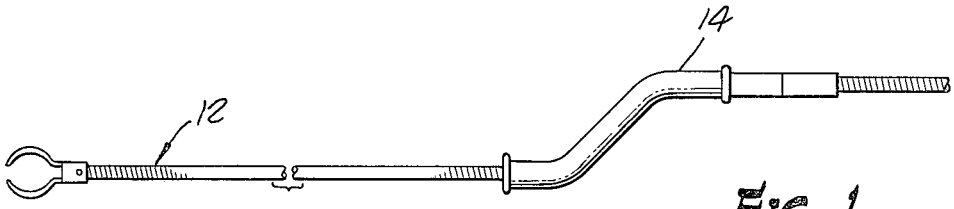
FIG. 1 is a side elevational view of a plumbers snake embodying the present invention shown interconnected with a handle member for operating the snake.

Referring to the drawings, and particularly to FIG. 1, the elongated flexible plumbers snake or cleaning element of the invention is designated by the numeral 12. Element 12 is shown interconnected with a crank handle 14 which is used to rotate the cleaning element or snake and to force it through the pipe to be cleaned.

Figure 2:
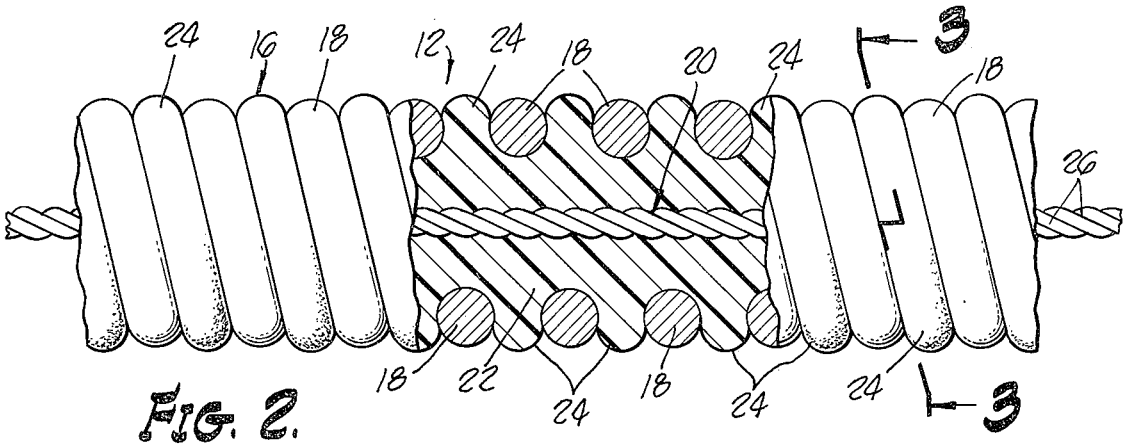
FIG. 2 is a central longitudinal view through the plumbers snake shown partly in cross-section and drawn on a much larger scale than that of FIG. 1.

Turning to FIG. 2, plumbers snake 12 can be seen to comprise a hollow outer body generally designated as 16 formed of a length of helically coiled spring steel wire 18, the turns of which are coiled in an axially spaced apart relation. An inner concentrically aligned core 20 is disposed within outer body 16 and extends longitudinally thereof. Surrounding core 20 is a longitudinally extending resilient non-metallic intermediate body 22 which is carried within outer body 16 and is adapted to grippingly engage metal core 20. Intermediate body 22 has along its periphery axially spaced apart helically shaped coils 24 adapted to extend between and cooperatively engage turns 18 of the helically coiled spring steel wire of the outer body. Intermediate body 22 may be formed of a thermoformable plastic, a rubber or similar material which is ductile but yet tough and corrosion resistant. Although various thermoformable plastic or rubbery materials can be used for the intermediate body, either polyvinylchloride or polyethylene has proved to be satisfactory for many applications. The density of the material selected for the intermediate body must be such as to render the body pliable but still stiff enough to lend rigidity to the snake. Further, the material must be selected so that the coils 24 of the intermediate body are capable of cooperating with the coils 18 of the outer body so as to resist bending of the snake along its longitudinal axis. To insure the desired cooperative interaction between the outer body 16 and the intermediate body 22 during flexure of the snake, the latter body is formed so that the compressible coils or prominence 24 thereof closely conforms to the shape of the coiled spring steel wire 18, with the outer diameter of coils 24 substantially corresponding to the outer diameter of coils 18 of outer body 16. The cooperative interaction between the steel coils 18 and the coils 24 of the intermediate body serves not only to lend rigidity to the snake but also serves to protect the steel coils against corrosion and wear, thereby substantially increasing the useful life of the device.

Figure 3:
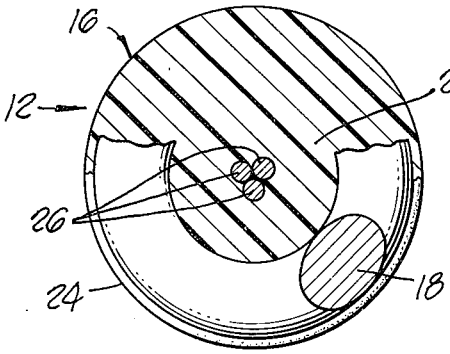
FIG. 3 is a sectional view taken along lines 3—3 of FIG. 2.

Referring to FIG. 3, flexible metal core 20 which also lends rigidity and strength to the snake is shown in this form of the invention as comprising several strands 26 of wire which may be either straight or twisted. In the particular example, there is shown a core of three twisted strands of wire. The external diameter of this core should be substantially less than the internal diameter of outer body 16.

Figure 4:
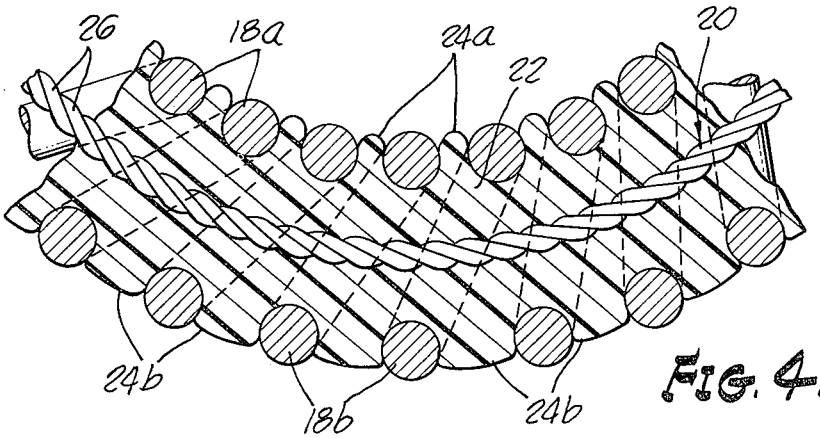
FIG. 4 is a view similar to FIG. 2 but showing the snake in a flexed configuration and illustrating the interaction between the yieldable spiral coils of the intermediate body and the steel coils of the coil spring outer body.

The unique interaction between the component parts of the flexible plumbers snake of the present invention is best illustrated in FIG. 4. As seen in this Figure, which is somewhat exaggerated to better illustrate the result, when the snake is bent, core 20 and intermediate body 22 bend with the coils 24*a* on one side of intermediate body 22 being yieldably compressed by the coils 18*a* of the outer body 16. On the opposite side of the plumbers snake, the coils 24*b* of the intermediate body expand but due to the pliability of the material of the intermediate body, remain in engagement with the coils 18*b* of the outer body, thereby continuously protecting the steel coils 18 of the outer body against wear and corrosion. Due to the resilience of the coils 24 of the intermediate body, they yieldably resist the tendency of the spring steel coils 18 to move toward one another during the bending of the plumbers snake. In this way, during use the overall rigidity of the device is increased with no substantial sacrifice in flexibility. Additionally, the novel interaction between the component parts of the device enables the snake to be sharply bent without kinking. Also because of the resilience of the intermediate body, the snake may be stored in a coiled configuration without retaining a permanent set.

In manufacturing the plumbers snake of the present invention, the thermoformable resilient plastic or rubber material of the intermediate body is formed about the flexible metal core in a manner well known in the art to produce an elongated generally cylindrical body coaxially aligned with the metal core. The outer diameter of the body is controlled to be slightly larger than the inside diameter of the coiled spring which forms the outer body of the snake.

After formation of the intermediate body, a spring steel wire is tightly coiled about the intermediate body to form the helically coiled spring steel outer body of the plumbers snake. The turns of the outer body are intentionally spaced apart and because of the pressure exerted on the yieldable intermediate body by the coiled spring wire, the outer portions thereof are caused to extend a limited distance between the turns of the wire. The assemblage thus formed is then controllably heated in an appropriate oven or furnace to a temperature sufficient to cause the intermediate body to become soft and to expand. Expansion of the intermediate body causes the material at the surface thereof to be further extruded between the coils of the spring steel outer body thereby forming a spiral shaped protrusion extending along its entire length. The assemblage is then cooled so that the material of the intermediate body is "set" in the expanded configuration with the turns of the spiral shaped protrusion formed thereon being interposed between and in operable engagement with the coils of the spring steel outer body.

The temperature range selected, the length of time at which the assemblage is maintained at the elevated temperature, and the method of cooling the assemblage, of course, depend upon the material selected for use in forming the intermediate body as well as the size of the device being manufactured. By way of example of the novel method of the invention, there is set forth in the paragraphs which follow the steps of the process and processing parameters selected in manufacturing one form of the plumbers snake of the invention where polyvinylchloride is used for the intermediate body.

First, the polyvinylchloride is formed around the flexible metal core to produce a generally cylindrically shaped intermediate body having an outer diameter of on the order of 0.320 inches. Next, the spring steel wire is helically wound about the intermediate body to form a hollow outer body having an inner diameter of on the order of 0.310 inches. The assemblage thus formed is then placed in an oven wherein the temperature is gradually raised to between approximately 375°F. and approximately 425°F. At a temperature of on the order of 350°–400°F., the polyvinylchloride becomes soft and begins to expand. The assemblage is maintained at the elevated temperature for between 10 and 20 minutes, during which time as the polyvinylchloride material continues to expand it will be extruded between the coils of the spring steel wire to form a spiral or helically shaped protrusion. The degree of expansion of the material is controlled so that the outer diameter of the protrusion on the intermediate body will approximate the outer diameter of the outer spring steel body. Finally, the assemblage is controllably cooled by either air or liquid bath cooling, in a manner well known in the plastic arts, to cause the polyvinylchloride to permanently set into the expanded configuration.

It is to be understood that different processing parameters will be selected when other materials are used. For example, when polyethylene is used for the intermediate body, lower temperatures and shorter time periods are used.

Although there is shown and described one form of the invention, it is contemplated that various changes and modifications can be made therein without departing from the invention, the scope of which is indicated by the following claims.

I claim:

1. A flexible plumbers snake comprising:

a. a hollow outer body formed of a length of helically coiled spring steel wire the turns of which are coiled in an axially spaced apart relation;

b. an inner concentrically aligned flexible metal core disposed within said outer body and extending longitudinally thereof;

c. a longitudinally extending resilient nonmetallic intermediate body carried within said outer body in gripping engagement with said core having along its periphery a spiral shaped compressible prominence adapted to extend between and cooperatively engage the turns of said helically coiled spring steel wire of said outer body whereby said prominence will yieldably resist any bending of said outer body along its longitudinal axis.

2. A plumbers snake as defined in claim 1 in which said compressible prominence closely conforms to the shape of said coiled spring steel wire and has an outer diameter substantially corresponding to that of said outer body.

3. A plumbers snake as defined in claim 2 in which said intermediate body is formed of a yieldable plastic material.

4. A flexible plumbers snake comprising:

a. a hollow outer body formed of a length of left hand wound helically coiled spring steel wire the turns of which are coiled in an axially spaced apart relation;

b. an inner concentrically aligned flexible metal core comprising a plurality of twisted strands of wire disposed within said outer body and extending longitudinally thereof;

c. a longitudinally extending resilient yieldable plastic intermediate body carried within said outer body in gripping engagement with said core having along its periphery a generally helically shaped compressible prominence having coils closely conforming to the shape of the space between the turns of said coiled spring steel wire of said outer body, said coils of said prominence being adapted to extend between and cooperatively engage the turns of said wire of said outer body to yieldably resist any bending of said outer body along its longitudinal axis.

5. A plumbers snake as defined in claim 4 in which the outer diameter of the coils of the prominence of said intermediate body substantially corresponds to that of said outer body with said coils of said prominence being adapted to remain in engagement with the turns of said spring steel wire during flexing of the snake along its longitudinal axis.

6. A method of manufacturing a plumbers snake comprising the steps of:

a. forming resilient thermoformable plastic material around an elongated flexible metal core to produce a generally cylindrically shaped body;

b. tightly coiling a spring steel wire around said body along its entire length to form a helically coiled outer body, the turns of which are spaced apart;

c. heating the assemblage thus formed to a temperature sufficient to cause said plastic to soften and expand whereby portions thereof will be extruded between the turns of said outer body; and d. controllably cooling said plastic to cause it to permanently set in its expanded configuration.

7. The method as defined in claim 6 in which said plastic is polyvinylchloride and said assemblage is heated to a temperature of between approximately 375° to 425°F. and maintained at the elevated temperature for a period of approximately 15 minutes.

8. A method of manufacturing a flexible plumbers snake consisting of the steps of:

a. forming polyvinylchloride around a flexible metal core to produce a generally cylindrically shaped body;

b. tightly helically winding a spring steel wire around said body along its entire length to form a coiled outer body, the turns of which are spaced apart;

c. heating said plastic and said outer body to a temperature of approximately 400°F.;

d. maintaining the temperature of said plastic and said outer body at said elevated temperature for a period of approximately 15 minutes; and e. controllably cooling said plastic and said outer body.

* * * * *